US011395523B2

(12) United States Patent
Nishiura et al.

(10) Patent No.: US 11,395,523 B2
(45) **Date of Patent: *Jul. 26, 2022**

(54) OUTSOLE AND SHOE

(71) Applicant: ASICS CORPORATION, Hyogo (JP)

(72) Inventors: Yusuke Nishiura, Hyogo (JP); Junichiro Tateishi, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 73 days.

This patent is subject to a terminal disclaimer.

(21) Appl. No.: 16/473,628

(22) PCT Filed: Dec. 28, 2016

(86) PCT No.: PCT/JP2016/089068

§ 371 (c)(1),
(2) Date: Jun. 26, 2019

(87) PCT Pub. No.: WO2018/123005

PCT Pub. Date: Jul. 5, 2018

(65) Prior Publication Data

US 2019/0335850 A1 Nov. 7, 2019

(51) Int. Cl.

| | |
|---|---|
| ***A43B 13/22*** | (2006.01) |
| ***A43B 13/26*** | (2006.01) |
| ***A43B 13/04*** | (2006.01) |
| ***A43B 13/18*** | (2006.01) |

(52) U.S. Cl.

CPC ..... *A43B 13/04* (2013.01); *A43B 13/184* (2013.01); *A43B 13/223* (2013.01); *A43B 13/26* (2013.01)

(58) Field of Classification Search

CPC ..... A43B 5/08; A43B 13/122; A43B 13/22; A43B 13/223; A43B 13/26

See application file for complete search history.

(56) References Cited

U.S. PATENT DOCUMENTS

| | | | | |
|---|---|---|---|---|
| 3,328,901 | A * | 7/1967 | Strickland | A43C 15/161 36/59 R |
| 4,281,467 | A * | 8/1981 | Anderie | A43B 13/223 36/32 R |
| 4,570,362 | A * | 2/1986 | Vermonet | B60C 11/0311 36/59 C |
| 4,578,883 | A * | 4/1986 | Dassler | A43B 5/00 36/116 |

(Continued)

FOREIGN PATENT DOCUMENTS

| | | |
|---|---|---|
| CN | 101188955 | 5/2008 |
| CN | 201976874 | 9/2011 |

(Continued)

OTHER PUBLICATIONS

"International Search Report (Form PCT/ISA/210)" of PCT/JP2016/089068, dated Mar. 14, 2017, with English translation thereof, pp. 1-4.

(Continued)

*Primary Examiner* — Sharon M Prange
(74) *Attorney, Agent, or Firm* — JCIPRNET

(57) ABSTRACT

Provided in the present invention is an outsole including a sheet body which includes a substrate sheet and a continuous body secured to the substrate sheet, and a shoe that has the continuous body having a certain shape and thereby being excellent in functionality.

12 Claims, 5 Drawing Sheets

(56) References Cited

U.S. PATENT DOCUMENTS

| | | | | |
|---|---|---|---|---|
| 4,685,224 | A * | 8/1987 | Anger | A43B 17/08 36/43 |
| 5,617,653 | A * | 4/1997 | Walker | A43B 13/26 36/128 |
| 6,032,388 | A | 3/2000 | Fram | |
| 7,313,876 | B2 * | 1/2008 | Morgan | A43B 1/0027 36/59 R |
| 7,788,827 | B2 * | 9/2010 | Fogg | A43B 13/026 36/59 C |
| 10,258,104 | B2 * | 4/2019 | Kraft | A43B 13/04 |
| 2002/0035796 | A1 | 3/2002 | Knoche et al. | |
| 2006/0225305 | A1 | 10/2006 | Morgan et al. | |
| 2012/0073160 | A1 | 3/2012 | Marvin et al. | |
| 2012/0110876 | A1 | 5/2012 | Lubart | |
| 2013/0167402 | A1 | 7/2013 | Christensen et al. | |
| 2015/0128455 | A1 | 5/2015 | Lubart | |
| 2015/0313310 | A1 * | 11/2015 | Okamoto | A43B 13/184 36/31 |
| 2016/0095384 | A1 | 4/2016 | Kraft | |
| 2016/0174659 | A1 | 6/2016 | Lubart | |

FOREIGN PATENT DOCUMENTS

| | | |
|---|---|---|
| CN | 102450773 | 5/2012 |
| CN | 202907968 | 5/2013 |
| CN | 105476174 | 4/2016 |
| CN | 105873464 | 8/2016 |
| DE | 102007024427 | 12/2008 |
| EP | 2433515 | 3/2012 |
| EP | 2609823 | 7/2013 |
| EP | 3001924 | 4/2016 |
| JP | H04276204 | 10/1992 |
| JP | H09123315 | 5/1997 |
| JP | 2001510389 | 7/2001 |
| JP | 2015077475 | 4/2015 |
| WO | 9956576 | 11/1999 |
| WO | 2015052813 | 4/2015 |

OTHER PUBLICATIONS

"International Preliminary report on patentability (Form PCT/IB/373, Form PCT/IB/338, Form PCT/IB/326) of PCT/JP2016/089068", dated Jul. 2, 2019, with English translation of written opinion (Form PCT/ISA/237), pp. 1-13.

"Search Report of Europe Counterpart Application", dated Jun. 29, 2020, p. 1-p. 7.

"Office Action of China Counterpart Application" with English translation thereof, dated Apr. 2, 2021, p. 1-p. 11.

"Office Action of China Counterpart Application", dated Sep. 22, 2020, pp. 1-7.

* cited by examiner

OUTSOLE AND SHOE

CROSS-REFERENCE TO RELATED APPLICATION

This application is a 371 application of the international PCT application serial no. PCT/JP2016/089068, filed on Dec. 28, 2016. The entirety of the abovementioned patent application is hereby incorporated by reference herein and made a part of this specification.

FIELD

The present invention relates to an outsole and a shoe including the outsole.

BACKGROUND

Shoes such as sports shoes conventionally are made up of many members.

For example, a sole is made up of members, such as an inner sole, a sock liner, a midsole and an outsole.

Shoes are required to have functions of not only giving comfortable wearing feeling to the wearer, but also supporting the wearer's motion, such as running and stopping.

Therefore, shoes being excellent in functionality, such as easy-to-deform properties and grip performance are required so far.

A sport shoe has a ground engaging surface that is provided with a tread formed with a plurality of protrusions in the same manner as a vehicle tire in order to provide excellent grip performance.

In this regard, for example, Patent Literature 1 below describes that the ground engaging surface of the shoe is provided with a tread formed with a plurality of protrusions called tread elements carried on one surface side of a sheet-shaped substrate.

CITATION LIST

Patent Literature

Patent Literature 1: WO99/56576

SUMMARY

Technical Problem

Shoes are required to have grip performance as mentioned above.

However, shoes are not necessarily required to have the same degree of the grip performance in all directions.

For example, although high grip performance is required for the motion, such as running or stretching the legs apart from each other in the right-left direction, such high grip performance is not required for the motion, such as closing the legs stretched in the right-left direction.

Thus, the grip performance of the shoes is required to be exhibited in a specific direction.

Further, a shoe sole is largely bent usually at toe's root when the wearer walks.

Therefore, from the standpoint of comfortability in walking, the emphasis is placed more on the bend performance of the shoe sole forming member exhibited in the longitudinal direction of the foot than that exhibited in the width direction of the foot.

Thus, the mechanical performance characteristics required for members forming the shoe sole, such as an outsole are greatly changed depending on the direction in which they are exhibited.

Anisotropy on the grip performance, the bend performance and the like of the conventional outsoles is exhibited by providing different shapes to the treads on the outside and the inside of the foot, or providing partly thin portions.

However, mere application of these techniques has limitations in allowing anisotropy to be exhibited in the mechanical performance characteristics of the outsole, which poses a problem of making it hard for the conventional outsole to satisfactorily exhibit the required characteristics.

Further, since the tread of the conventional outsole is made up of individual protrusions, the protrusions may fall off from the outsole due to excessive force or the like applied to the shoe sole even if the mechanical performance characteristics such as the grip performance are improved.

Therefore, an object of the present invention is to provide an outsole that is capable of easily meeting the requirements on the mechanical performance characteristics, and hence provide a shoe that is excellent in functionality.

Solution to Problem

In order to solve the problem, according to the present invention, there is provided an outsole including at least one sheet body, the at least one sheet body including a substrate sheet and a continuous body that is secured to the substrate sheet, the continuous body including a plurality of protrusions protruding from a surface of the substrate sheet and a connecting member that connects each adjacent ones of the plurality of protrusions on a base end side in a protruding direction, the substrate sheet including a covered portion that is covered by the continuous body and an exposed portion that is not covered by the continuous body to have the surface of the substrate sheet exposed to the outside therethrough, at least a part of the continuous body extending on the substrate sheet, and at least a part of the exposed portion extending along the extending continuous body.

Further, the present invention provides a shoe including the aforementioned outsole in order to solve the above problem.

DESCRIPTION OF EMBODIMENTS

The present invention will be hereinafter described by way of embodiments.

First Embodiment

First, the description will be made for a first embodiment with reference to FIGS. 1 and 2.

Figure 1:
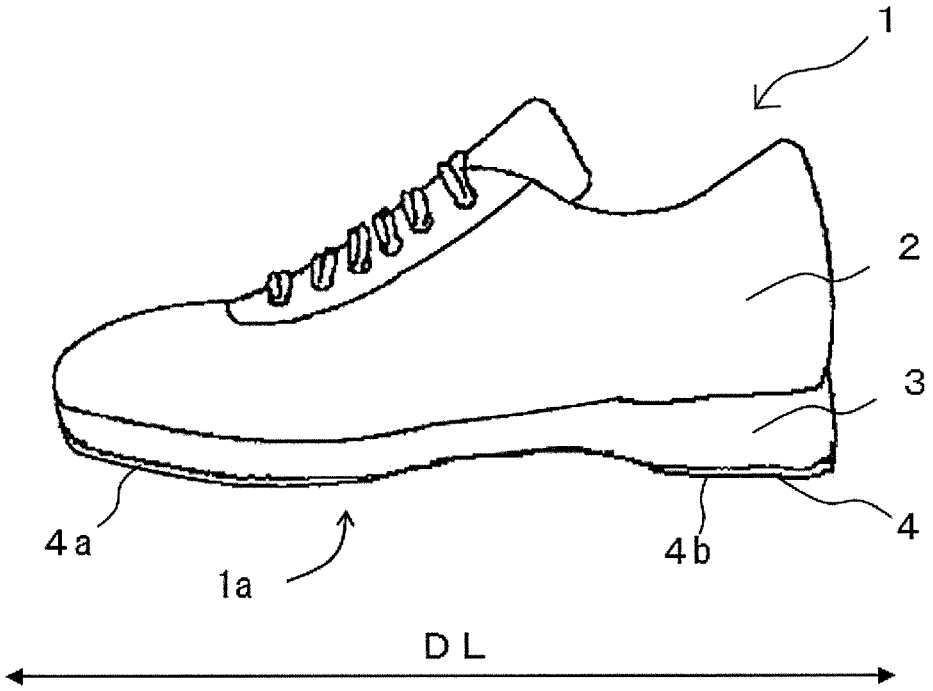
FIG. 1 is a schematic side view showing one form of a shoe.
Figure 2:
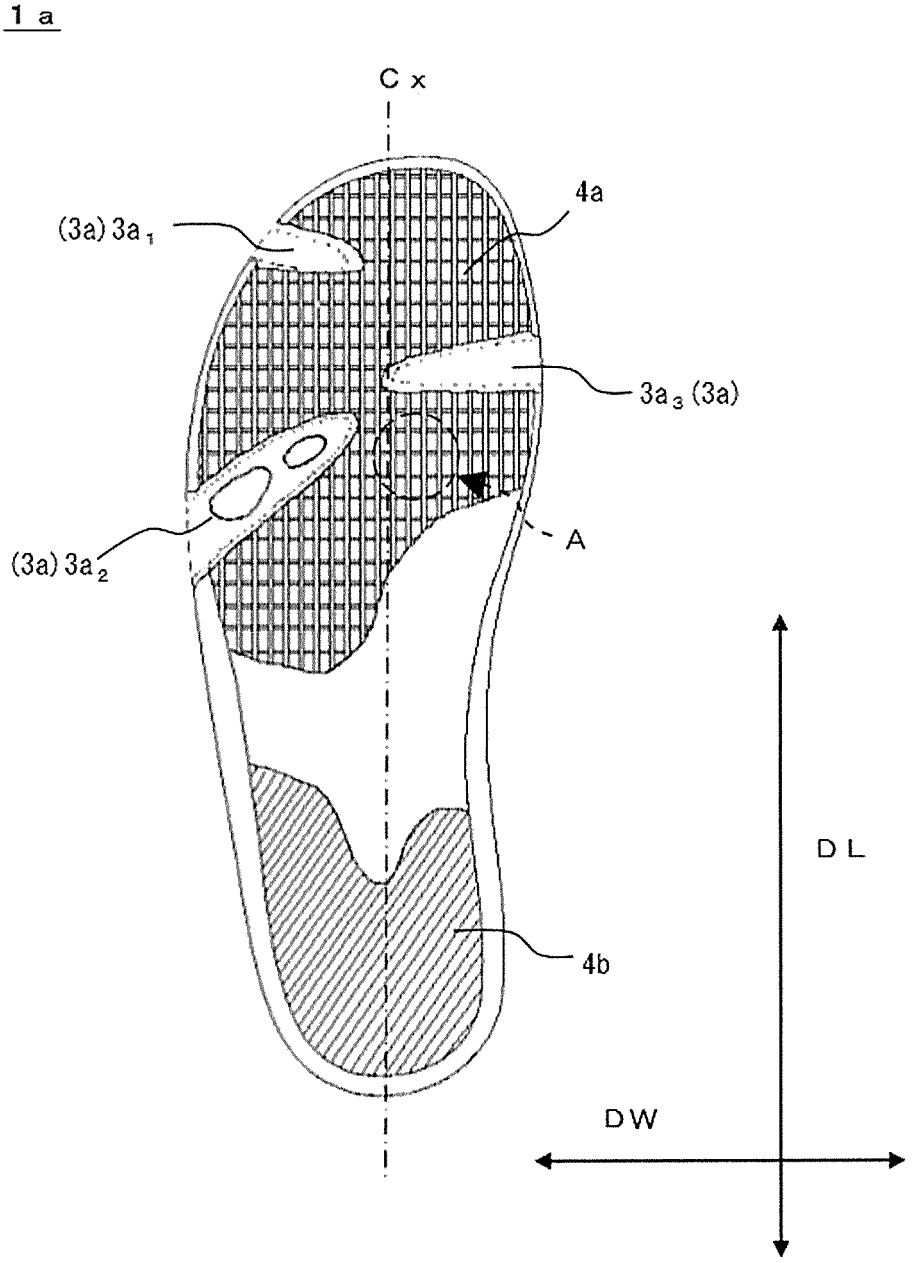
FIG. 2 is a schematic plan view showing the appearance of an outsole according to one embodiment, as viewed from the ground engaging surface side of the shoe.
Figure 3:
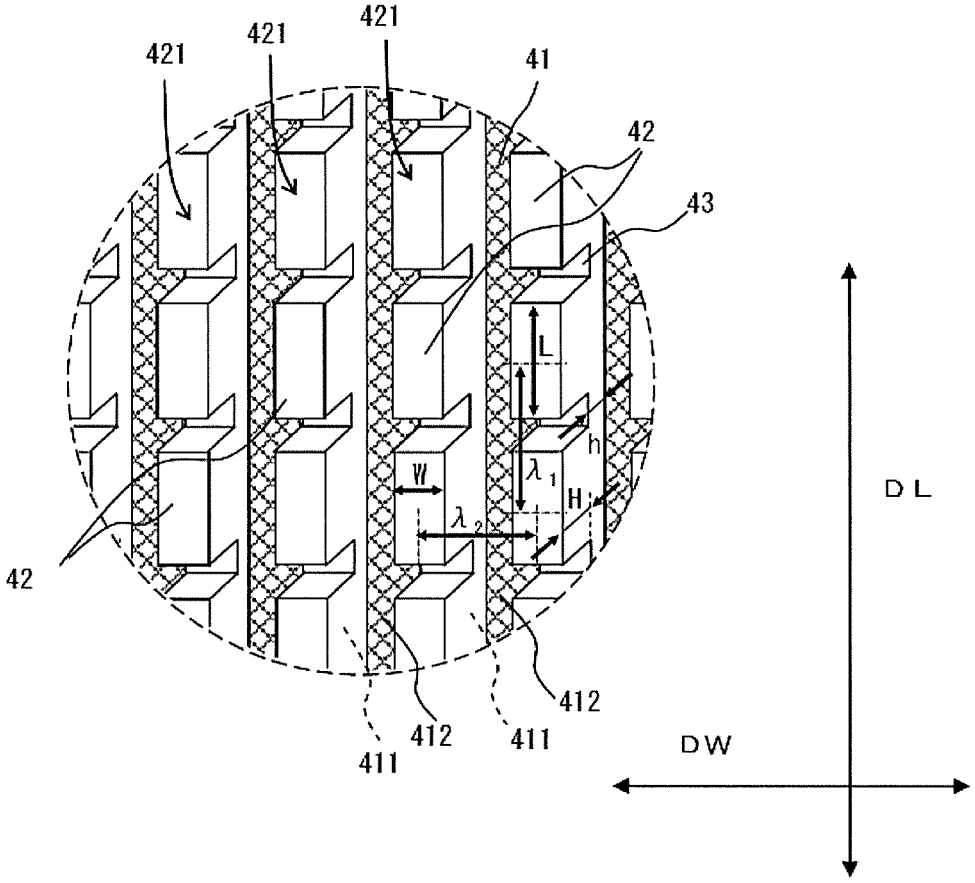
FIG. 3 is an enlarged view of an area surrounded by a dotted circle A of FIG. 2.

As shown in FIG. 1, a shoe 1 of this embodiment has an upper member 2, a midsole 3, and an outsole 4.

The midsole 3 of this embodiment has such a size that can cover entirely the sole of the foot when the shoe 1 is viewed from the ground engaging surface side.

On the other hand, the outsole 4 of this embodiment is configured to partly cover this midsole 3 when the shoe 1 is viewed from the ground engaging surface side.

The outsole 4 of this embodiment includes two sheets forming a tread on a ground engaging surface 1*a*, namely a first sheet 4*a* and a second sheet 4*b*.

More specifically, the outsole 4 of this embodiment includes the first sheet 4*a* arranged in a forefoot and the second sheet 4*b* arranged in a rearfoot.

That is, the first sheet 4*a* is shaped and arranged to cover from the sole of the foot an area extending from the tip of the toe to the arch of the foot, and the second sheet 4*b* is shaped and arranged to cover from the sole of the foot a peripheral area of the heel.

Hereinafter, the direction along which the first sheet 4*a* and the second sheet 4*b* are aligned with each other (the direction along a shoe center axis Cx) is sometimes referred to as the longitudinal direction DL of the shoe or foot, and a direction orthogonal to this longitudinal direction DL is sometimes referred to as the width direction DW.

The midsole 3 has recesses 3*a* in the forefoot that are recessed inward to extend upward from the ground engaging surface side.

Each of the recesses 3*a* has a shape elongating in the width direction of the shoe 1, and becomes narrow toward the depth side (upper side).

The midsole 3 has three recesses 3*a* having recessed areas extending from the periphery of the shoe center axis Cx to the outer peripheral edge of the shoe.

The midsole 3 of this embodiment has two recesses $3a_1$ and $3a_2$ that extend from the periphery of the shoe center axis Cx to the edge on the outside of the foot, and one recess $3a_3$ that extends from the periphery of the shoe center axis Cx to the edge on the laterally inner side of the foot.

The recesses $3a_1$, $3a_2$ and $3a_3$ provided in the midsole 3 enable the shoe 1 of this embodiment to exhibit excellent bend performance in the forefoot.

The first sheet 4*a* of the two sheets forming the outsole 4 has a substrate sheet and a continuous body secured to the substrate sheet.

The continuous body of the first sheet 4*a* includes a plurality of protrusions that protrude from a surface of the substrate sheet, and a connecting member that connects each adjacent ones of the plurality of protrusions on a base end side in the protruding direction.

The substrate sheet includes a covered portion that is covered by the continuous body, and an exposed portion that is not covered by the continuous body to have a surface of the substrate sheet exposed to the outside therethrough.

At least a part of the continuous body extends on the substrate sheet.

At least a part of the exposed portion extends along the extending continuous body.

The first sheet 4*a* is shaped and adhered to the lower surface of the midsole 3 to cover an area other than the openings of the recesses 3*a*.

The first sheet 4*a* has a plurality of protrusions (protruding portions) 42 having a rectangular parallelepiped shape.

The plurality of protrusions 42 have tip ends in the protruding direction to form the tread.

The plurality of protrusions 42 of this embodiment have the same shape.

The protrusions 42 have a rectangular parallelepiped shape each having a dimension in the longitudinal direction DL of the foot (hereinafter simply referred also to as the "longitudinal direction") which is larger than the dimension in the width direction DW of the foot (hereinafter simply referred also to as the "width direction").

The protrusions 42 of this embodiment are separated into plural groups, and adjacent ones of the protrusions 42 of each of the groups are connected to each other to constitute the continuous body 421.

That is, the protrusions 42 constitute a plurality of the continuous bodies 421.

More specifically, each of the continuous bodies 421 includes a plurality of protrusions 42 that protrude from the surface of the substrate sheet 41, and raised ridges (connecting portions) 43 each connecting adjacent ones of the protrusions 42 on the base end side in the protruding direction.

A group of the protrusions 42, together with the raised ridges 43, constitutes each of the continuous bodies 421, in which adjacent ones of the protrusions 42 are connected to each other on the base end side in the protruding direction with the raised ridges 43 that have a height lower than the protrusions 42.

Each of the continuous bodies 421 of this embodiment linearly extends by way of connection with the raised ridges 43 toward one direction.

That is, at least a part of each of the continuous bodies 421 extends on the substrate sheet.

Each of the continuous bodies 421 of this embodiment linearly extends in the entire shape.

Each of the continuous bodies 421 may extend in a curved shape or a wave line shape.

The protrusions 42 and the raised ridges 43 of the continuous bodies 421 of this embodiment are made of the same elastomer composition.

On the other hand, the substrate sheet 41 is formed with a material different from that of the protrusions 42 and the raised ridges 43, and is formed with a fibrous material (fiber sheet) in this embodiment.

The continuous bodies 421 are adhered to the substrate sheet 41 on the base end side of the protrusions 42.

The protrusions 42 are connected in the longitudinal direction DL so that each of the continuous bodies 421 extends along the longitudinal direction DL.

The outsole 4 of this embodiment has the plurality of continuous bodies 421 extending in parallel with each other.

That is, the first sheet 4*a* includes plural strips of the continuous bodies 421 extending in the longitudinal direction DL, and these continuous bodies 421 are arranged on the first sheet 4*a* at intervals in the width direction DW.

A fiber sheet used as the substrate sheet 41 is held in exposed state between the adjacent continuous bodies 421 in the width direction DW of the first sheet 4*a*.

That is, the substrate sheet 41 includes covered portions 411 covered by the continuous bodies 421, and exposed portions 412 not covered by the continuous bodies 421 to have the surface of the substrate sheet 41 exposed to the outside therethrough. The covered portions 411 and the exposed portions 412 have linear shapes that extend along the longitudinal direction DL of the shoe.

The first sheet 4*a* is configured to have the covered portions 411 and the exposed portions 412 of the substrate sheet 41 alternately arranged in the width direction DW of the shoe.

That is, the exposed portions 412 also have linear shapes extending in parallel with each other and are formed in the first sheet 4*a* in the same manner as the continuous bodies 421.

The linear exposed portions 412 have a shape reaching a peripheral edge of the first sheet 4*a*.

According to the first sheet 4*a* having the above configuration, while the protrusions 42 are connected to each other in the longitudinal direction DL, they are not connected to each other in the width direction DW.

Therefore, the bending strength of the first sheet 4*a* when it is bent at a midpoint in the longitudinal direction DL, and the tensile strength of the same in the longitudinal direction DL are greatly influenced by the tensile strength and the bending elastic modulus of the continuous bodies 421.

Further, the bending strength of the first sheet 4*a* when it is bent at a midpoint in the width direction DW and the tensile strength of the same in the width direction DW are greatly influenced by the tensile strength and the bending elastic modulus of the substrate sheet 41.

That is, when the mechanical performance characteristics of the first sheet 4*a* are measured in various directions, the measured result in the longitudinal direction DL is greatly influenced by the continuous bodies 421, and when the measuring direction of the mechanical performance characteristics is gradually changed from the longitudinal direction DL toward the width direction DW, the influence of the substrate sheet 41 gradually increases.

Therefore, not only the mechanical performance characteristics in the longitudinal direction DL and the width direction DW but also the mechanical performance characteristics in the directions other than these directions are adjustable according to the selected shape or material of the continuous bodies 421, or the selected thickness or material of the substrate sheet 41.

The size and pitch of the protrusions 42 are set preferably within a certain range in order to allow the shoe 1 of this embodiment to exhibit excellent grip performance on the asphalt concrete road surface.

The protrusions 42A have a protruding height H of preferably not less than 0.01 mm and not more than 5 mm from the upper surfaces of the raised ridges 43.

The protrusions 42 have a protruding height H of more preferably not less than 0.5 mm and not more than 4 mm, and even more preferably not less than 0.6 mm and not more than 1.8 mm from the upper surfaces of the raised ridges 43.

The protrusions 42 have a protruding height of preferably not less than 0.02 mm and not more than 10 mm, more preferably not less than 1 mm and not more than 8 mm, and even more preferably not less than 2 mm and not more than 7 mm from the substrate sheet 41.

The size and pitch of the raised ridges 43 are set preferably within a certain range in order to allow the shoe 1 of this embodiment to exhibit the bend performance.

The raised ridges 43 have a protruding height h of preferably not less than 0.01 mm and not more than 5 mm, more preferably not less than 0.1 mm and not more than 3.0 mm, and even more preferably not less than 0.5 mm and not more than 2.5 mm from the substrate sheet 41.

Taking into account excellent grip performance on the asphalt concrete road surface, the protrusions 42 preferably have a tip end shape (a shape of the ground engaging face) as described below.

Specifically, a length L of the protrusions 42 in the direction in which the continuous body 421 extends (longitudinal direction DL) is preferably not less than 1 mm and not more than 10 mm, more preferably not less than 2 mm and not more than 8 mm, and even more preferably not less than 3 mm and not more than 7 mm.

A pitch $\lambda_1$ (distance between the centers) of the protrusions 42 in the extending direction of the continuous body 421 (longitudinal direction DL) is preferably not less than 2 mm and not more than 20 mm, more preferably not less than 3 mm and not more than 15 mm, and even more preferably not less than 4 mm and not more than 10 mm.

The proportion length of the protruding portions of the protrusions 42 to the entirety of the continuous body 421 ($L/\lambda_1 \times 100\%$) is preferably not less than 40% and not more than 99%, more preferably not less than 50% and not more than 95%, and even more preferably not less than 60% and not more than 90%.

The width W of the protrusions 42 in the direction (width direction DW) orthogonal to the extending direction of the continuous body 421 is preferably not less than 0.5 mm and not more than 10 mm, more preferably not less than 1 mm and not more than 8 mm, and even more preferably not less than 1.5 mm and not more than 5 mm.

The ratio of the length L to the width W of the protrusions 42 (L/W) is preferably not less than 1 and not more than 10, more preferably not less than 1.5 and more preferably not more than 8, and even more preferably not less than 2 and not more than 5.

A pitch $\lambda_2$ (distance between the centers) of the continuous body 421 in the extending direction of the continuous body 421 (width direction DW) is preferably not less than 0.5 mm and not more than 10 mm, more preferably not less than 1 mm and not more than 8 mm, and even more preferably not less than 1.5 mm and not more than 5 mm.

It is preferable that the continuous body 421 occupy a space volume from the substrate sheet 41 to the ground engaging surface by a certain proportion or more.

A space volume V ($mm^3$) from the substrate sheet 41 to the ground engaging surface can be obtained by "S×T", where an area of the substrate sheet 41 in the first sheet 4*a* is represented by S ($mm^2$), and a thickness of the space from the substrate sheet 41 to the ground engaging surface is represented by T (mm: T=H+h).

Accordingly, when the value obtained by summing up the volumes of all the continuous bodies 421 provided in the first sheet 4*a* is represented by $V_1$ ($mm^3$), the proportion ($V_1/V \times 100\%$) by which the total value ($V_1$) occupies the space volume (V) is preferably not less than 30% and not more than 90%, more preferably not less than 40% and not more than 80%, and even more preferably not less than 50% and not more than 75%.

This embodiment is described by taking, for example, the case where the outsole is formed by the first sheet 4*a* with all the protrusions 42 having the same rectangular parallelepiped shape, but it is not necessary that the protrusions 42 forming the continuous body 421 have the same size and have the rectangular parallelepiped shape.

For example, the protrusions may have a polygonal column shape having a polygonal section other than a rectangular section taken along a plane parallel to the substrate sheet 41, or a cylindrical shape having a perfect circle section, an elliptic section, or an oval section taken along the same plane.

Further, the protrusions may have a polygonal cone shape or a conical shape, or a truncated conical shape (a truncated pyramid shape, a truncated cone shape or the like).

Still further, the protrusions may have a hemispherical shape or any irregular shape.

Also in these cases, the preferable ranges for the pitch of the protrusions in the longitudinal direction DL and the pitch of the continuous bodies in the width direction DW are the same as those for the case where all the protrusions have a rectangular parallelepiped shape.

The protrusions may have a linear shape or a meshed shape.

The meshed protrusions may have a lattice pattern or a honeycomb pattern.

For the meshed protrusions (protruding portions) having a lattice pattern (lattice structure) or a honeycomb pattern (honeycomb structure), when the total area of the substrate sheet 41 covered by all the continuous bodies is 100%, the area of the substrate sheet 41 covered by the protrusions may be, for example, not less than 40% and not more than 99%.

The connecting form of the connecting portions for connection between each adjacent two protrusions is not necessarily one linear body, but may be two or more linear bodies or a meshed body.

The connecting portions do not necessarily have a linear shape, but may be a cylindrical shape or a polygonal column shape.

Figure 4:
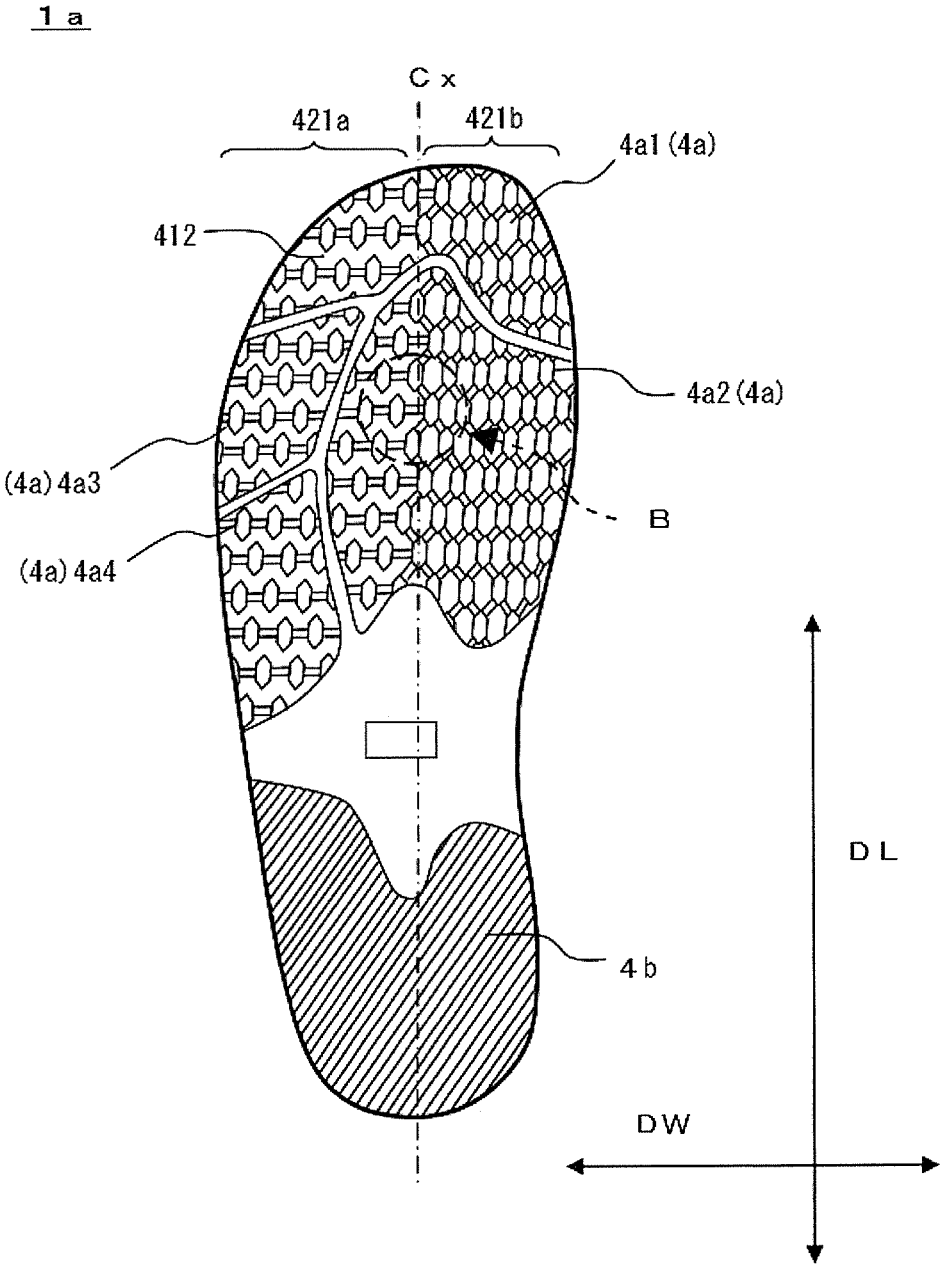
FIG. 4 is a schematic plan view showing the appearance of an outsole according to another embodiment, as viewed from the ground engaging surface side of the shoe.
Figure 5:
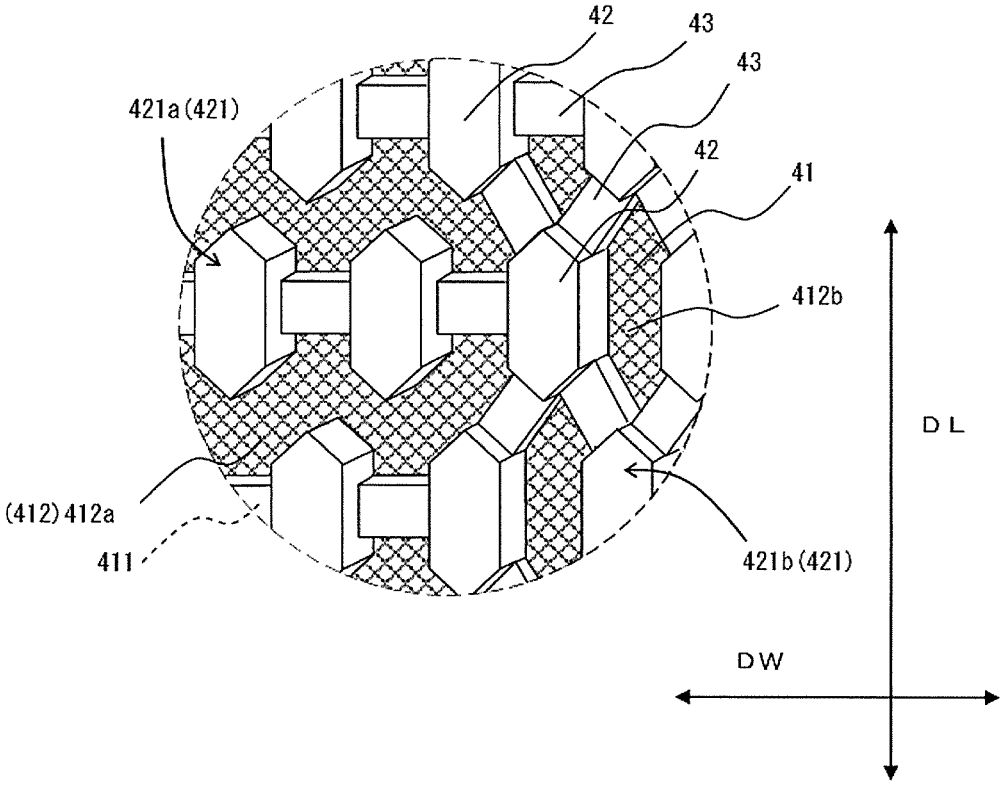
FIG. 5 is an enlarged view of an area surrounded by a dotted circle B of FIG. 4.

Now, the description will be made for a second embodiment of the invention relating to the outsole with reference to FIGS. 4 and 5.

The outsole of this embodiment is the same as the outsole of the first embodiment in that it includes the first sheet 4*a* arranged in a forefoot and the second sheet 4*b* arranged in a rearfoot.

The outsole 4 of the second embodiment is different from the outsole 4 of the first embodiment in that the first sheet 4*a* is composed of four separate pieces, namely a first separate piece 4*a*1, a second separate piece 4*a*2, a third separate piece 4*a*3, and a fourth separate piece 4*a*4.

That is, the outsole 4 of this embodiment, which is composed of 5 sheets, is different from the outsole 4 of the first embodiment, which is composed of two sheets.

While all the continuous bodies 421 of the outsole 4 of the first embodiment respectively have linear shapes extending along the longitudinal direction DL of the shoe, only the continuous bodies 421 on the laterally outside of the outsole 4 respectively have linear shapes in the second embodiment, and the continuous bodies 421 on the laterally inner side have a meshed pattern.

Further, in the outsole 4 of the second embodiment, the portion of the continuous bodies 421 where the continuous bodies 421 have a linear shape (hereinafter referred also to as the "linearly shaped portion 421*a*") extends not in the longitudinal direction DL but in the width direction DW.

The exposed portions 412 of the substrate sheet 41 of the second embodiment extend along the continuous bodies 421 in the linearly shaped portion 421*a* in the same manner as those of the first embodiment, but the portion of the continuous bodies 421 where the continuous bodies 421 have a meshed pattern (hereinafter referred also to as the "meshed portion 421*b*") has the peripheral areas of the exposed portions 412 surrounded by the covered portions 411.

That is, the exposed portions 412 are present as dots in the meshed portion 421*b*.

The exposed portions 412 in the linearly shaped portion 421*a* are present as plural linear forms extending in parallel with each other in the same manner as the continuous bodies 421.

That is, there are an area where the exposed portions 412 are present as plural linear forms (linear pattern area) and an area where exposed portions 412 are present as dots (dot pattern area).

At least one end of each of the exposed portions 412 in the linearly shaped portion 421*a* reaches a peripheral edge of the substrate sheet.

The end edges of the exposed portions 412 extending along the continuous bodies 421 are located at the peripheral edge of the substrate sheet 41, so that the outsole of this embodiment has significant anisotropy in the mechanical performance characteristics, and excellent flexibility.

The linearly shaped portion 421*a* and the meshed portion 421*b* are arranged in the second separate piece 4*a*2 in the same manner as the first separate piece 4*a*1, but only the linearly shaped portion 421*a* is located in each of the third separate piece 4*a*3 and the fourth separate piece 4*a*4.

In the linear pattern area of the exposed portions 412, where the exposed portions 412 are present as plural linear forms, the both ends of each of the exposed portions 412 reach the peripheral edge of the substrate sheet.

That is, the anisotropy of the mechanical performance characteristics in the third separate piece 4*a*3 and the fourth separate piece 4*a*4 is more significant than that in the first separate piece 4*a*1 and the second separate piece 4*a*2.

According to the first embodiment, only each adjacent two front and rear protrusions 42 in the extending direction of the continuous bodies 421 are connected to each other, but, according to the second embodiment, each three or more of the protrusions 42 are connected to each other in the meshed portion 421*b*.

Specifically, in the meshed portion 421*b*, one protrusion 42 is connected to four different protrusions 42 located in the periphery respectively by four raised ridges 43.

While the protrusions 42 of the first embodiment have a rectangular parallelepiped shape, the protrusions 42 of the second embodiment have a hexagonal columnar shape.

According to the outsole 4 of this embodiment, each of the continuous bodies 421 is provided with the connecting portions 42 with which the protrusions 42 are connected to each other, so that the protrusions 42 are suppressed or prevented from falling off from the substrate sheet 41.

In addition, in the outsole 4 of the second embodiment, the protrusions 42 in the meshed portion 421*b* more hardly fall off from the substrate sheet 41.

According to this embodiment, the shoe 1 can exhibit excellent grip performance because the meshed portion 421*b* of the continuous bodies 421 is arranged on the laterally inner side of the forefoot to which a large force is likely to be applied during running or the like.

The shoe of this embodiment can exhibit excellent grip performance as well as prevent or suppress the falling-off of the protrusions by providing a larger number (in average) of separate protrusions to be connected to each one protrusion in each of the continuous bodies on the laterally inner side of the forefoot than the number of the separate protrusions on the laterally outside of the forefoot.

In this embodiment, the shoe 1 can exhibit excellent bend performance by having the linearly shaped portion 421*a* extending in the width direction DW.

A conventional rubber may be used as a main component of an elastomer composition for forming the continuous bodies 421 as described in the first embodiment and the second embodiment.

Specifically, as an elastomer to be contained in the elastomer composition, one or two or more selected from the group consisting of, for example, natural rubber (NR), isoprene rubber (IR), butadiene rubber (BR), styrene-butadiene rubber (SBR), butyl rubber (IIR), chloroprene rubber (CR), acrylonitrile butadiene rubber (NBR), ethylene propylene rubber (EPR), ethylene propylene diene rubber (EPDM), silicone rubber (Q), urethane rubber (U), fluororubber (FKM), chlorinated polyethylene (CM), and chlorosulfonated polyethylene (CSM) can be employed.

Further, as an elastomer to be contained in the elastomer composition, one or two or more thermoplastic elastomers selected from the group consisting of, for example, an olefin-based thermoplastic elastomer (TPO), a styrene-based thermoplastic elastomer (TPS), an amide-based thermoplastic elastomer (TPA), a urethane-based thermoplastic elastomer (TPU), and an ester-based thermoplastic elastomer (TPC) can be employed.

A conventional thermoplastic resin may be contained in the elastomer composition.

As the thermoplastic resin, one or two or more selected from the group consisting of, for example, polyethylene resin (PE), polypropylene resin (PP), ethylene-vinyl acetate copolymer resin (EVA), ethylene-methyl acrylate copolymer resin (EMA), ethylene-ethyl acrylate copolymer resin (EEA), ethylene-methyl methacrylate copolymer resin (EMMA), a cyclic polyolefin resin, (COP, COC), polyamide resin (PA), polyester resin (PET, PBT, PEN . . . ), polystyrene resin (GPPS, HIPS, AS, ABS, . . . ), an acrylic resin, polycarbonate resin (PC), polyvinyl chloride resin (PVC), and 1,2-butadiene resin (PBD) can be employed.

A conventional thermosetting resin may be contained in the elastomer composition.

As the thermosetting resin, one or two or more selected from the group consisting of, for example, an epoxy resin, a phenol resin, a polyurethane resin, a melamine resin, and an unsaturated polyester resin can be employed.

In the elastomer composition, additives may be further contained, such as a crosslinking agent, a scorch retarder, a peptizer, a slipping agent, a mold releasing agent, a lubricant, an aging retardant, an antioxidant, a weather-proof agent, a flame retarder, a pigment, an electrostatic preventing agent, an antimicrobial agent, a deodorizer, an inorganic filler, a silane coupling agent, and a tackifier.

It is preferable that the elastomer composition have thermoplasticity when it is in the form of the continuous bodies 421.

Accordingly, the elastomer composition is preferably configured so that, even when it is subjected to crosslinking by a crosslinking agent or the like, the crosslinking reaction is limited to an extent called such as partial crosslinking.

A fiber sheet (substrate sheet 41) which, together with the elastomer composition, forms the first sheet 4*a* can be knitted fabric, woven fabric or nonwoven fabric.

The term "nonwoven fabric" is used herein to mean that it includes felt in addition to those defined in JIS L0222.

The substrate sheet 41 used in forming the first sheet 4*a* preferably does not have an excessive thickness, and a sheet having a thickness smaller than that of conventional felt is preferably used.

The substrate sheet 41 preferably has a thickness of not less than 0.1 mm and not more than 2 mm.

The substrate sheet 41 more preferably has a thickness of not less than 0.2 mm and not more than 1 mm.

A fiber sheet employed as a substrate sheet can have easily controllable cushioning properties, anisotropy and stretching properties.

A resin film employed as a substrate sheet can have both excellent stiffness and a reduced thickness, and therefore provide a lightweight outsole.

A fiber reinforced plastic sheet employed as a substrate sheet can easily have both excellent stiffness and a reduced thickness, and therefore provide a more lightweight outsole.

A resin foamed sheet employed as a substrate sheet enables a resin foam provided as midsole to be used as a substrate sheet, which can simplify the shoe manufacturing process.

In this case, the substrate sheet can have a thickness suitable as midsole.

A non-foamed resin sheet employed as a substrate sheet can have an increased stiffness, which enables deformation of outsole to be easily controlled.

While the first sheet 4*a* is made to exhibit anisotropy in mechanical performance characteristics according to the arrangement of the continuous bodies 421, a fiber sheet that has anisotropy in mechanical performance characteristics is preferably employed also as the substrate sheet 41.

For example, a stretchable cloth called such as one-way stretch is preferably used as the substrate sheet 41.

It is preferable that the substrate sheet 41 be used so as to allow a direction, in which its elongation power is highest when it is measured, to be aligned to a certain extent with the extending direction of the continuous bodies 421.

More specifically, the first sheet 4*a* is preferably configured so that an angle (acute angle) between the direction in which the elongation power when the substrate sheet 41 is elongated by 30% is highest and the extending direction of the continuous bodies 421 is not more than 30 degrees.

The aforementioned angle is more preferably not more than 20 degrees, and even more preferably not more than 15 degrees.

The elongation power of the fiber sheet employed as the substrate sheet 41 when it is elongated by 30% can be measured according to JIS L1096:2010 "Testing methods for woven and knitted fabrics" "8. 16. 3 elongation power", "B method".

The shoe 1 exhibits excellent grip performance during leg's forward and backward moving action such as running not only by forming the continuous bodies 421 along the longitudinal direction DL, but also by configuring the first sheet 4*a* using the substrate sheet 41 that exhibits a high elongation power in the longitudinal direction DL.

The shoe 1 gives comfortable wearing feeling because the first sheet 4*a* exhibits good stretching properties in the width direction DW.

When the direction in which the elongation power of a fiber sheet (at elongation of 30%) is highest is designated as a first direction, and the direction orthogonal to the first direction is designated as a second direction, the ratio (F2/F1) of the elongation power in the second direction (F2) to the elongation power in the first direction (F1) is preferably not less than 0.01 and not more than 0.8.

The aforementioned ratio is more preferably not more than 0.6 and even more preferably not more than 0.5.

The shoe 1 is also advantageous in that the first sheet 4*a* can be easily manufactured by aligning the direction in which the elongation power of the substrate sheet 41 is highest with the extending direction of the continuous bodies 421.

Giving an explanation on the aforementioned regard, it is preferable that no adhesive be required for adhering the continuous bodies 421 and the substrate sheet 41 together from the viewpoint of achieving a simplified method for manufacturing the first sheet 4*a*.

Accordingly, the continuous bodies 421 and the substrate sheet 41 are preferably configured so that they can be adhered to each other by impregnating the fiber sheet of the substrate sheet 41 with the elastomer composition of the continuous bodies 421.

In this case, the first sheet 4*a* can be produced by a method that includes, for example, placing a fiber sheet in a molding die having a molding face corresponding to the shape of the continuous bodies 421, and injecting the heated and molten elastomer composition into the molding die.

The first sheet 4*a* is produced preferably by injection molding, in which the injecting is directed from one end side toward the other end side of the continuous bodies 421.

Assuming the case where plural protrusions that form no continuous bodies (separate protrusions) are formed by injection molding, the elastomer composition is generally injected into the molding die to have its injection direction being perpendicular to the fiber sheet, unlike the first sheet 4*a*.

In this case, the molding die is generally required to have the same number of gates as the number of the protrusions, and have runners having a complicated shape.

On the other hand, the first sheet 4*a* is provided with the protrusions that form the plural continuous bodies 421 of which the connection directions are the same as each other, and therefore the first sheet 4*a* can be produced in the injection molding by injecting the elastomer composition into the molding die in a direction parallel to the surface of the fiber sheet.

Further, the number of gates of the molding die for producing the first sheet 4*a* can be reduced as compared with the number of the protrusions, and for example, the number of the gates can be equal to the number of the continuous bodies 421.

Still further, when the first sheet 4*a* is produced by the injection molding, it is possible to suppress or prevent occurrence of deformation of the fiber sheet at the time of injecting the elastomer composition into the molding die by aligning the direction in which the elongation power of the fiber sheet is high with the extending direction of the continuous bodies 421.

Thus, the first sheet 4*a* can be produced while suppressing any limitations on the molding conditions for the injection molding.

That is, the first sheet 4*a* is advantageous also in that it can be produced by a simple method.

When the first sheet 4*a* is produced by the injection molding, the mechanical performance characteristics of the continuous bodies 421 in the longitudinal direction can be differentiated from those in the width direction by causing molecular orientation in the elastomer composition.

Whether the molecules of the continuous bodies 421 are oriented or not, and how high the molecules are oriented can be confirmed by the polarized Raman spectroscopy analysis using specimens cut out from the continuous bodies 421.

In the injection molding, the molten elastomer composition to be injected into the molding die can easily reach every corner in the molding die when the elastomer composition has low viscosity.

The elastomer composition preferably has low melt viscosity from the viewpoint of the impregnating ability to the fiber sheet (adhesivity to the fiber sheet).

The elastomer composition is preferably used for injection molding under such temperature conditions as to have a melt viscosity of less than 600 Pa·s at a shear rate of 100 $s^{-1}$, and preferably used under the conditions to have a melt viscosity of less than 600 Pa·s.

The elastomer composition preferably has a melt viscosity as mentioned above ($n<600$ Pa·s) at 240° C., more preferably has a melt viscosity as mentioned above at 220° C., and particularly preferably has a melt viscosity as mentioned above at 180° C.

The melt viscosity can be measured by the method defined by JIS K 7199.

The continuous bodies 421 can be rigidly secured to the substrate sheet 41 by impregnating part of the elastomer composition of the continuous bodies 421 in the substrate sheet 41.

Accordingly, the elastomer composition of the continuous bodies 421 is preferably impregnated in the substrate sheet 41 to protrude from the opposite surface of the substrate sheet 41.

The fiber sheet employed as the substrate sheet 41 enables the rigid securing of the continuous bodies 421 as aforementioned, while any materials other than the fiber sheet may be employed.

The substrate sheet 41 may be a resin film, a fiber reinforced plastic sheet, a resin foamed sheet, or the like.

A resin film of various materials and various thicknesses is commercially available.

Therefore, outsoles designed according to different purposes can be easily provided by employing a resin film as the substrate sheet.

For example, outsoles designed according to different purposes can be produced by first determining the material for forming the continuous bodies 421 in terms of the grip performance and the like, and then selecting a resin film from the commercially available products, which can exhibit good adhesiveness to the continuous bodies 421.

The fiber reinforced plastic sheet (FRP) employed as the substrate sheet can provide outsoles being excellent in stiffness.

The foamed sheet employed as the substrate sheet can provide outsoles being excellent in cushioning properties and lightness.

When these materials are employed as the substrate sheet, they are prepared with through holes formed at plural places corresponding to the covered portions 411, and are subjected to injection molding as mentioned above, so that part of the elastomer composition of the continuous bodies 421 can be made to flow out through the through holes onto the side opposite to the side on which the continuous bodies 421 are formed.

The flown-out elastomer composition can form protrusions on the side opposite to the side of the substrate sheet, on which the continuous bodies 421 are formed, and the protrusions each have an area larger than that of the corresponding through hole in plan view.

Thus, the continuous bodies 421 are connected with the protrusions on the opposite side through the through holes to be rigidly secured to the substrate sheet.

The first sheet 4*a* can be produced using two kinds of the elastomer composition prepared in different colors, which enables switching the kind of the elastomer composition during injection into the molding die.

In this case, the first sheet 4*a* that has the continuous bodies 421 each having one end side and the other end side formed in different colors with gradation in the middle can be produced.

The first sheet 4*a* can be also produced using two kinds of elastomer composition prepared with the mechanical performance characteristics different from each other, which enables switching the kind of the elastomer composition during injection into the molding die.

In this case, the first sheet 4*a* that has the continuous bodies 421 each having one end side and the other end side in the longitudinal direction respectively formed with the different mechanical performance characteristics with intermediate mechanical performance characteristics in the middle can be produced.

The first sheet 4*a* may be produced using three or more kinds of the elastomer composition.

The first sheet 4*a* may be produced by changing the kind of the elastomer composition for each of the continuous bodies 421.

The description is given for this embodiment by taking, for example, the case where the continuous bodies 421 are formed using the elastomer composition having thermoplastic property, but even if the elastomer composition for forming the continuous bodies 421 is replaced with a reaction-curable composition such as a two-liquid curing type polyurethane resin composition and an addition-reaction silicone rubber composition, there is no difference in that they can also be subjected to injection molding and enable ease of manufacturing the first sheet 4*a*.

The protrusions 42 and the raised ridges 43 which together constitute each of the continuous bodies 421 are formed using the same material in order to easily manufacture the first sheet 4*a*, but they may be formed using different materials according to needs and circumstances.

The second sheet 4*b* which, together with the first sheet 4*a*, constitutes the outsole 4 may be formed using the same material as that of the first sheet 4*a* or a different material therefrom.

When the second sheet 4*b* is formed using the different material from the first sheet 4*a*, it can be in the form of an elastomer sheet having an uneven surface or the like.

That is, although the rearfoot sole is less likely to be applied with complex stress compared with the forefoot sole which makes complex movements during walking or the like, the second sheet 4*b* may be provided with the same continuous bodies as those of the first sheet 4*a* for the purpose of giving the anisotropy to the mechanical performance characteristics or preventing falling-off of the protrusions.

Therefore, the second sheet 4*b* may be the same as a sheet conventionally used for outsoles.

Conventionally known materials can be used for the members other than the outsole which constitute the shoe 1, such as the upper member 2 and the midsole 3.

The shoe 1 provided with the aforementioned outsole 4 can easily satisfy the required mechanical performance characteristics.

The outsole and the shoe of the present invention are not necessarily limited to the above embodiments, and can be subjected to various modifications within the gist of the present invention.

The outsole of the present invention may extend upward to constitute a part of the upper member.

It is evident from the aforementioned description that, according to the present invention, an outsole effective for forming a shoe excellent in functionality is provided.

REFERENCE SIGNS LIST

1: Shoe
2: Upper member
3: Midsole
4: Outsole
41: Substrate sheet
42: Protrusion
43: Raised ridge
421: Continuous body

The invention claimed is:

1. An outsole comprising at least one sheet body, the at least one sheet body comprising a substrate sheet and a plurality of strips of continous bodies that is secured to the substrate sheet, each of the plurality of strips of continous bodies comprising a plurality of protrusions protruding from a surface of the substrate sheet and a connecting member that connects each adjacent ones of the plurality of protrusions on a base end side in a protruding direction, the substrate sheet comprising a covered portion that is covered by the continous bodies, and an exposed portion that is not covered by the continous bodies to have the surface of the substrate sheet exposed to the outside therethrough, at least a part of the continous bodies extending on the substrate sheet, and at least a part of the exposed portion extending along the extending continous bodies, wherein the plurality of strips of continuous bodies extending in one direction that is a longitudinal direction of a shoe are provided, and the plurality of strips of continuous bodies are arranged on the substrate sheet at intervals in a width direction of the shoe, each of the continuous bodies is a linear structure that linearly extends by way of connection with the connecting member toward the one direction;

wherein each of the plurality of protrusions has a size in the longitudinal direction being larger than a size in the width direction, and a height of the connecting member is lower than a height of the protrusion.

2. The outsole according to claim 1, wherein the exposed portion extending along the continuous body has end edges located at a peripheral edge of the substrate sheet.

3. The outsole according to claim 1, wherein the plurality of protrusions and the connecting member of the continuous body are made of the same elastomer composition.

4. The outsole according to claim 1, wherein the substrate sheet comprises a fiber reinforced plastic sheet.

5. The outsole according to claim 1, wherein the substrate sheet comprises a resin foamed sheet.

6. A shoe comprising the outsole according to claim 1.

7. The outsole according to claim 1, wherein the protrusions and the connecting member of each of the plurality of continuous bodies are arranged alternately to each other in the longitudinal direction, wherein the protrusions of the plurality of the continuous bodies are not connected to each other in a width direction of the shoe, and wherein the covered portions and the exposed portions are alternately arranged in the width direction of the shoe.

8. The outsole according to claim 7, wherein the substrate sheet comprises a fiber sheet or a resin film.

9. The outsole according to claim 7, wherein each of the plurality of the protrusions has a size in the longitudinal direction being larger than the size in the width direction.

10. A shoe comprising the outsole according to claim 7.

11. An outsole comprising at least one sheet body, the at least one sheet body comprising a substrate sheet and a plurality of strips of continous bodies that is secured to the substrate sheet, each of the plurality of strips of continous bodies comprising a plurality of protrusions protruding from a surface of the substrate sheet and a connecting member that connects each adjacent ones of the plurality of protrusions on a base end side in a protruding direction, wherein the connecting member and each of the plurality of protrusions have the same width, the substrate sheet comprising a covered portion that is covered by the continous bodies, and an exposed portion that is not covered by the continous bodies to have the surface of the substrate sheet exposed to the outside therethrough, at least a part of the continous bodies extending on the substrate sheet, and at least a part of the exposed portion extending along the extending continous bodies, wherein the plurality of strips of continuous bodies extending in one direction that is a longitudinal direction of a shoe are provided, and the plurality of strips of continuous bodies are arranged on the substrate sheet at intervals in a width direction of the shoe, wherein each of the plurality of protrusions has a size in the longitudinal direction being larger than a size in the width direction, and a height of the connection member is lower than a height of the protrusion.

12. An outsole comprising at least one sheet body, the at least one sheet body comprising a substrate sheet and a plurality of strips of continous bodies that is secured to the substrate sheet, each of the plurality of strips of continous bodies comprising a plurality of protrusions protruding from a surface of the substrate sheet and a connecting member that connects each adjacent ones of the plurality of protrusions on a base end side in a protruding direction, the substrate sheet comprising a covered portion that is covered by the continous bodies, and an exposed portion that is not covered by the continous bodies to have the surface of the substrate sheet exposed to the outside therethrough, at least a part of the continous bodies extending on the substrate sheet, and at least a part of the exposed portion extending along the extending continous bodies, wherein the plurality of strips of continuous bodies extending in one direction that is a longitudinal direction of a shoe are provided, and the plurality of strips of continuous bodies are arranged on the substrate sheet at intervals in a width direction of the shoe, in the width direction of the shoe, the protrusions are not connected to each other, the continuous body in which the protrusions and the connecting members are alternately arranged is extended along a length direction of the shoe, the continuous body extending along the length direction includes the protrusions whose dimensions in the length direction are longer than the dimensions in the width direction, and a height of the connection member is lower than a height of the protrusion, the covered portion and the exposed portion are provided alternately in the width direction of the shoe.

* * * * *